United States Patent [19]

McIntire et al.

[11] 4,117,824

[45] Oct. 3, 1978

[54] AUTOMATIC WOOD BURNING HEATING STOVE

[76] Inventors: Kendrick H. McIntire, Rte. 2, Box 1000; John E. McIntire, Rte. 2, Box 151-A, both of Aurora, Oreg. 97002

[21] Appl. No.: 742,558

[22] Filed: Nov. 17, 1976

[51] Int. Cl.[2] ..... F24B 11/00

[52] U.S. Cl. ..... 126/15 R; 126/4; 126/62; 126/65; 126/77; 126/140; 126/290

[58] Field of Search ..... 126/15 R, 123, 140, 126/141, 60, 62, 65, 77, 287, 126, 4, 194, 190, 197, 120, 58; 292/238

[56] References Cited

U.S. PATENT DOCUMENTS

| | | | |
|---|---|---|---|
| 19,956 | 4/1858 | Spear | 126/15 R |
| 199,964 | 2/1878 | Davenport | 292/238 |
| 566,732 | 9/1896 | Anderson | 126/4 |
| 576,775 | 2/1897 | Cohen | 126/190 |
| 1,222,894 | 4/1917 | Scruggs | 126/194 |
| 1,674,379 | 6/1928 | Taliaferro | 126/126 |
| 1,674,566 | 6/1928 | Phillips | 126/65 X |
| 2,302,197 | 11/1942 | Edwards | 126/15 R |
| 2,345,519 | 3/1944 | Wingery | 126/77 |
| 3,134,886 | 5/1964 | Simpson | 126/21 R X |
| 3,196,252 | 7/1965 | Weingrad | 126/190 X |
| 4,027,649 | 6/1977 | Jackson | 126/62 X |

FOREIGN PATENT DOCUMENTS

| | | | |
|---|---|---|---|
| 2,414,072 | 10/1974 | Fed. Rep. of Germany | 126/190 |
| 246,930 | 10/1947 | Switzerland | 126/15 R |
| 463,231 | 3/1937 | United Kingdom | 126/190 |

*Primary Examiner*—William F. O'Dea
*Assistant Examiner*—Harold Joyce
*Attorney, Agent, or Firm*—Klarquist, Sparkman, Campbell, Leigh, Hall & Whinston

[57] ABSTRACT

An automatic wood burning heating stove has a fire chamber, a fuel feeding opening, closeable by an air-tight door which is removable to convert the heater to an open fireplace. The door has a reflective ceramic surface on its inner face to direct heat toward preheating tubes having outlets directed above the fire zone. The door also reflects heat toward a downdraft preheating passage at the back of the stove. The draft preheating passage has a thermostatically controlled door which is closed when the stove is converted to a fireplace.

11 Claims, 3 Drawing Figures

AUTOMATIC WOOD BURNING HEATING STOVE

BACKGROUND OF THE INVENTION

In this age of dwindling natural resources, specifically oil, natural gas and electricity, the heating of homes has become a major expense. Even wood as a fuel (with which most people are acquainted) is in short supply in some areas. There is need, therefore, to use such fuel as efficiently as possible, extracting the full BTU value as is mechanically practical in a device having no powered assists. Further, such a heating device should be at least semi-automatic to conform to the habits of a generation used to automatic applicances. Such a device should also take the place of an open fireplace which an affluent generation has come to expect as a necessary part of a home but which is notoriously wasteful of the natural wood resource and, in fact, heats very little and, in some cases, extracts more heat than it provides.

SUMMARY OF THE INVENTION

This invention is an automatic wood burning heating stove. Certainly wood burning heating stoves are not new so it must be stated that what makes this invention unique is a combination of features, the sum total of which has resulted in a new kind of product. The unique product is a two-way heating device. The primary function of this heating stove is to function as an efficient, airtight heating stove with automatic and secondary drafts. Wood burning heating stoves have traditionally been associated with certain areas and considered strictly the utilitarian appliances of those who could not afford the more sophisticated automatic heating devices or perphas a fireplace, which also has been an expensive installation. This new invention has lifted such stoves out of this category by providing a way to remove the necessary airtight fuel door by a simple maneuver and also by a simple adjustment to seal off the draft tube, thus converting the automatic airtight wood burning heating stove into a simple wood burning open fireplace. The automatic features no longer operate under these conditions and so the entire mode of operation of such stove has been changed. This we feel to be the main feature of the present invention. It is true that there are other stoves which convert from closed door operation, such as the "Franklin" fireplace, but we must understand that the combustion of fuel in such stoves in no way approximates the low-oxygen conditions under which the airtight wood burning heating stove of the present invention operates. The convertible nature of the stove of this invention thus fills the need of those who wish to have the option of seeing an open fire occasionally without sacrificing permanently the efficiency of an airtight automatic wood burning heating stove.

In addition to the above primary function, there are other features which we feel are improvements over other airtight wood burning heating stoves. We feel our down draft preheating manifold is an improvement over other so-called "preheated drafts" because our draft is placed on that portion of the stove where the highest temperature is registered, namely, the central back portion of the stove. Higher temperatures are registered here due to the position of the chimney stack directly above such area. Hot gases are thus channeled toward the back heating this part of the stove to a higher temperature than any other part. The advantage of this positioning of the manifold is the heating of the oxygen which is being channeled down the preheating manifold, one side of which is formed by the back of the stove. Such preheating is understood by those skilled in the trade to promote a much more efficient combustion of the wood fuel. Working in conjunction with such downdraft preheating manifold and automatic thermostat (which controls air admission) are two preheated updraft secondary draft tubes which provide preheated air to the upper part of the combustion chamber to promote the burning of otherwise wasted volatile gases. Some wood burning heating stoves provide for secondary draft through simple holes but not the preheating of such draft. Our draft tubes make their entry low in the fire box on the back of the stove and thus present their surface to the hot fire over a considerable distance before bending outwardly and upwardly toward the upper secondary fire zone finally terminating in a flared slit. Such slight restriction of the total cross-sectional area of such tubes at the termination increases the velocity of the entering hot air thus assuring a better mixing of air and hot gases which also assures their combustion. This provision is not only desirable for safety sake since it has been shown that unburned gases, such as pyroligneous acid, will condense in a cool chimney and later prove to be a fire hazard. The preheating of said tubes is also desirable since it has been demonstrated in solid fuel power plants that the preheating of such air assures complete combustion of such gases.

This invention includes, as mentioned above, a draft seal which is operated by a simple lever, the seal being attached immediately above the draft tube for preheating the manifold by a hinge. Such seal is an integral part of the stove and is necessary when operating the stove as an open fireplace since in this mode the manifold if open would allow some of the volatile gases and smoke to escape because the draft direction changes when the door is removed.

This invention also includes, as noted above, an airtight, removable, fuel door with an inner linear of spun ceramic. In addition to its function as a fuel door, it has been designed to reflect a portion of the generated heat toward the back of the stove to increase the heating effect of the manifold. This is made possible by reflection from a dense layer of spun ceramic between the outer and inner sections of the door. The door is precisely positioned opposite the manifold to achieve the optimum reflectivity toward the manifold area. We wish to enlarge further on the unique function and features of the airtight fuel door. The door has a pair of metal hook-like hinge rods which penetrate and, in effect, hinge to a hearth plate. The door has a gasket and when closed the latches clamp the gasket tightly against the jamb, thus rendering the stove "airtight" as the term is used in the industry. The latches have a unique design which assures that the latches cannot open of themselves due to the weight of the handle and when the gasket might become well seated through much use. The striker plate is open to the bottom rather than the top. The weight of the latch handle thus acts as a fulcrum and exerts a force upward into the striker plate.

Another feature of this invention is the provision for cooking on its top. A shortcoming of wood heating-wood cooking stoves is the lack of provision for controling the temperature of the cook-top with any degree of accuracy. This is assuming in the case of wood heating stoves, that there is provision for cooking on its top at all. Our invention has overcome this problem by providing an adequate cook-top and a thermostat comprising a bimetal coil easily reached from a standing position and which has infinite heat settings. Also, due to the large preheating manifold or draft tube, the temperature can be raised quickly when temperature is set higher and conversely lowered quickly by closing the draft tube by turning the temperature adjustment lower. Also, since the stove has been provided with a thermostat comprising a bimetal coil, the cooktop temperature can be set at any temperature and left unattended for extended periods of time sufficient to leave slow cooking foods unattended for eight to ten hours.

Another feature of this invention is a large fuel capacity. One of the outstanding requirements of an automatic wood burning heating stove is such a feature since this will allow its user to leave the stove unattended for up to twenty-four hours. In colder climates where freezing temperatures could damage plumbing it is desirable to be able to "bank" the fire when one must leave the home unattended for such a period of time. In the case of our stove, up to one hundred twenty five lbs. of wood may be stacked tightly in the fuel chamber and due to the preheating of combustion air, the fuel charge will continue to burn slowly, though tightly stacked together, by admission of air through the automatic draft.

Another feature of this invention necessary to its overall performance, and which we will now describe in more detail, is the draft seal. Sealing off the draft is necessary when the stove is converted to "open fire" use to prevent gases and smoke from exiting out of the draft tube now that combustion air is entering the stove by way of the fuel door. A whole new mode of combustion now takes over with cool and abundant air entering the stove from the front. In this mode there is no longer a vacuum pulling air down through the draft tube but now smoke wants to exit up in what now becomes a natural exit for such gases and smoke. The draft seal is a hinged mechanism with a soft gasket which can be lowered into position by means of a control rod which can be reached from the front of the stove.

DESCRIPTION OF THE PREFERRED EMBODIMENT

Figure 1:
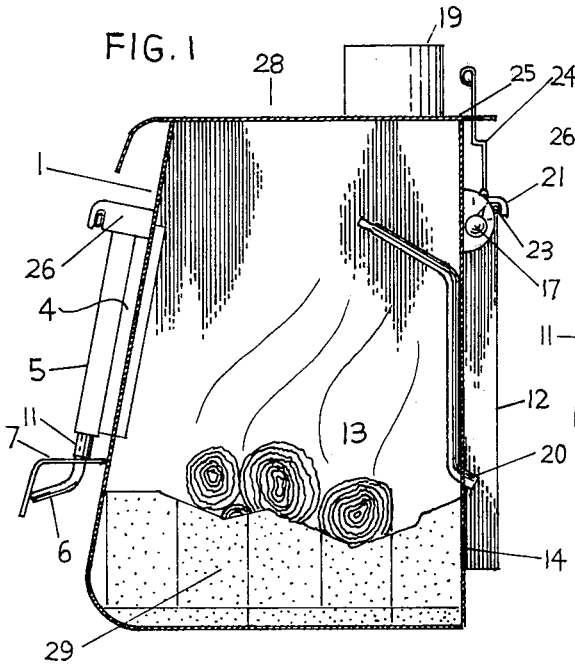
FIG. 1 is a vertical, sectional view of a stove forming one embodiment of the invention and taken along line 2—2 of FIG. 4.
Figure 4:
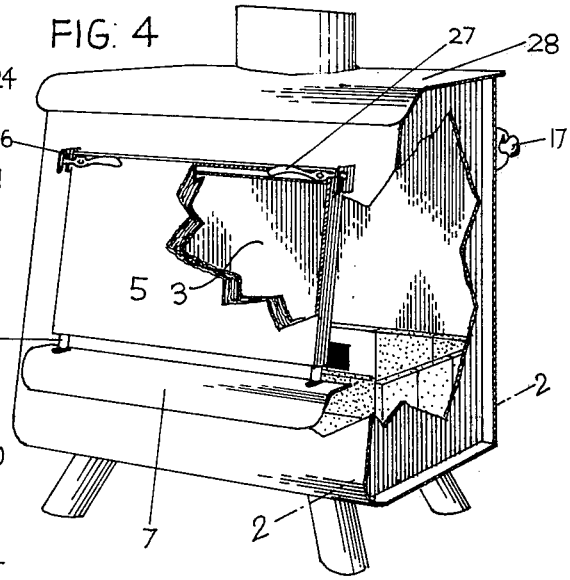
FIG. 4 is a perspective view of the stove of FIG. 1.

Referring now in detail to the drawings, a wood fueled automatic heating stove 1 comprises a body 2 which, in the form shown, is generally rectangular having a continuous side wall and a top and a bottom. The body 2 has an opening 3 on the front for feeding fuel, the bottom of the opening being a considerable distance above the bottom of the heater. The opening 3 is framed about by an outwardly projecting jamb 4 having an opening in the front closed by an airtight fuel door 5. The fuel door is also instantly removable by virtue of its unique hinge mechanism comprised of two curved rods 6 which penetrate through holes in support flange 7 below.

Figure 3:
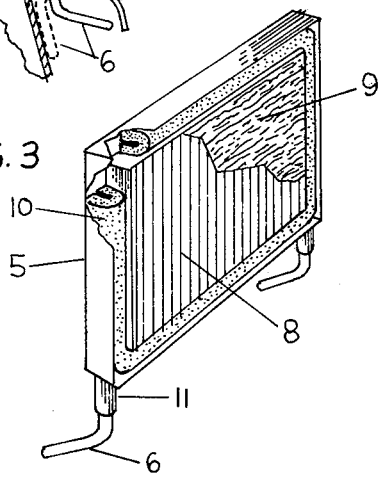
FIG. 3 is a perspective view of the removable fuel door showing the reflective inner shield partially cut away exposing the reflective spun ceramic insulation.

FIG. 3 shows a perspective view of said fuel door 5 from the inward side of the door showing inner reflective surface 8 of reflective ceramic partially cut away revealing reflective spun ceramic insulation 9. Also, this view shows the corners partially cut away revealing a high temperature gasket 10 folded double with the fold protruding toward the jamb. Immediately below the door 5 and enclosing the two curved hinge rods 7 are two spacer tubes 11 which hold the door up off the support flange 7 so that the door aligns correctly with the jamb 4.

Figure 2:
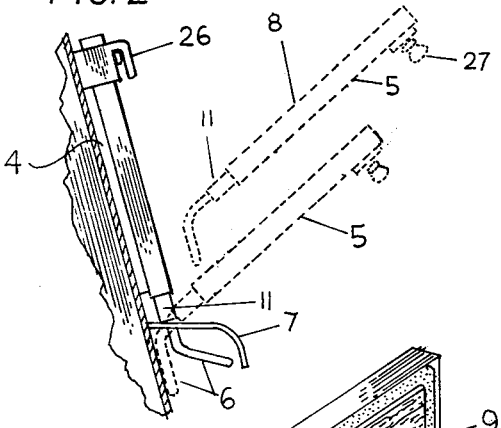
FIG. 2 is a fragmentary, vertical, sectional view of the removable fuel door of the stove in the closed, open and removed positions.

FIG. 2 shows the fuel door in the airtight closed position in full lines, and in phantom, an open position and removed positions illustrating removal of the door.

Figure 5:
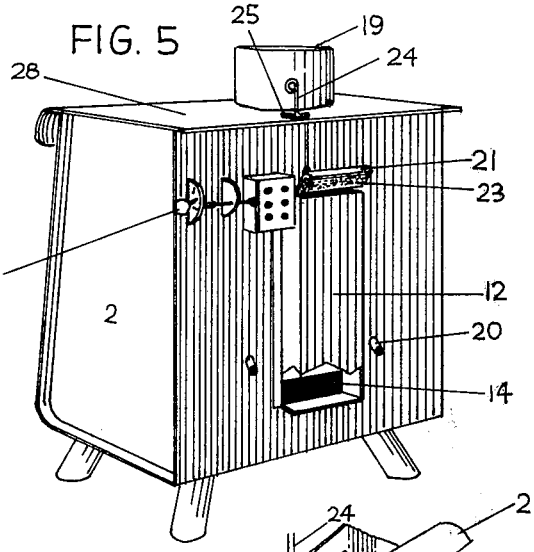
FIG. 5 is a perspective view of the stove of FIG. 1.
Figure 6:
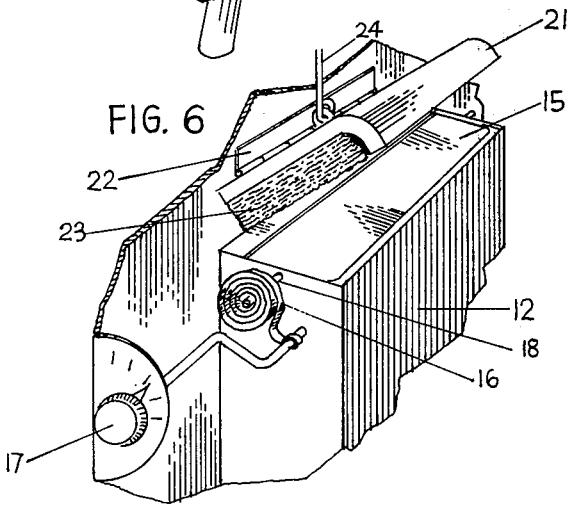
FIG. 6 is a perspective view of a draft manifold of the stove with bimetal coil thermostat attached and with draft seal attached; and, FIG. 7 is a perspective view of a latch of the stove of FIG. 1.

A downdraft preheating manifold 12 (FIGS. 1, 5 and 6) is attached to the back of the body 2 and communicates with the lower part of the fuel chamber 13 by means of a rectangular opening 14. A damper 15 is mounted in the upper portion of the preheating manifold and controls the draft to the fuel chamber. The damper 15 is operated by thermostat comprising a bimetallic spring 16 connected on one end to an adjusting knob 17, and the other end to a shaft of the damper 18, said coil being so arranged that as it heats it moves the damper 15 in a closing direction.

The top of the body 2 has an opening to a coupling pipe 19 near the back to receive the chimney stack pipe (not shown). The back of the body 2 has two secondary preheated draft tubes 20 admitting air at a level above the primary fire zone. This air is admitted at all times by virtue of the pull or suction from draft vacuum. The transverse cross-sectional area of the secondary air inlets or draft tubes 20 is much smaller than the volume of the primary draft inlet or preheating manifold 12 and so have little effect upon combustion during higher firing combustion conditions. The purpose of the secondary draft tubes 20 is to promote the combustion of wood gases under lower firing combustion conditions or when there is not sufficient oxygen entering the preheating manifold 12 due to the adjusting knob 17 being set at a low setting and, therefore, all available oxygen being burned in the primary fire or in the lower part of the combustion chamber.

The back of the body 2 (FIGS. 1 and 6) immediately above the preheating manifold has a draft seal 21 which is attached by means of a hinge 22 to the body 2. The draft seal is held down in the sealed position by virtue of its weight and the seal is formed by means of a gasket 23 attached to the bottom of this hinged plate which, in turn, fits tightly against the top of the draft manifold 12. The draft seal can be maintained in the open position by means of a bent rod 24 having two ninety degree bends forming a latch and, when in the open position rests on the top of the stove (FIGS. 1 and 5), the rod penetrating the top and held in a vertical position by means of a slot 25.

Figure 7:
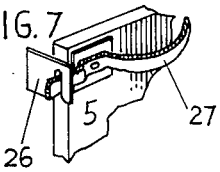

This invention includes a set of self-locking latches 27 (FIG. 7) which maintain themselves in the locked position due to open bottomed striker plate 26, the weight of the handle of the latches exerting a force upward into the notched striker plate. This invention also includes a cooktop 28 with the thermostat 17 (FIGS. 1 and 6) for setting cooking temperatures. A fire brick, cupped bottom 29 is provided for supporting a pile of wood logs directly thereon, the bottom being trough-like with thinner bricks at its ends and back to form a cup, except at the opening 14 which is unobstructed.

What is claimed is:

1. In a fireplace stove, a body having a front fireplace opening, an upper exhaust opening and a rear intake air opening, fireplace door means movable from a closed position sealing said front fireplace opening to an open position opening said front fireplace opening, closure means for closing said rear intake air opening while said door means is open and for opening said rear intake air opening when said door means is closed, and an air preheating passage extending downwardly along the back wall of said body to said rear intake air opening, said passage being open at its top, said back wall of said stove being of metal and forming one wall of said passage, the portion of said back wall forming said one wall of said passage being uninsulated substantially from the top of said passage to said rear intake air opening, whereby a fire in said stove can heat air entering said air preheating passage, said door means comprising reflective means for directing heat toward said portion of said back wall that forms said one wall of said passage.

2. The fireplace stove of claim 1 wherein the front of said body slopes upwardly and to the rear and said fireplace door means is disposed in said front.

3. The fireplace stove of claim 1 wherein said reflective means comprises reflective insulation disposed interiorly of said door means.

4. The fireplace stove of claim 1 wherein said fireplace door means comprises an inner surface of ceramic material and reflective insulation disposed interiorly of said inner surface.

5. The fireplace stove of claim 4 in which said reflective insulation comprises ceramic insulation.

6. The fireplace stove of claim 1, further comprising damper means mounted in said air preheating passage and thermostatic means for adjusting said damper means.

7. The wood stove of claim 6 wherein said damper means includes a plate member, a shaft mounting said plate member in said tube means, a bimetallic coil having one end keyed to a portion of said shaft just outside said tube means, and a manually adjustable member connected to the other end of said coil.

8. The fireplace stove of claim 1 wherein said closure means comprises a door at the top of said air preheating passage.

9. The fireplace stove of claim 1 including preheater tube means positioned at the rear of said body and having a lower inlet opening to the exterior of said body and an upper outlet opening into the upper portion of said body, the major portion of the length of said preheater tube means being exposed to the fire in said stove to preheat air passing therethrough.

10. The fireplace stove of claim 9 wherein said preheater tube means comprises a pair of S-shaped tubes having lower ends extending through said back wall of said body at opposite sides of said air preheating passage.

11. The fireplace stove of claim 1 further comprising firebox means comprising brick means formed into a cup with an opening aligned with said rear intake air opening, said rear intake air opening being disposed in said back wall of said stove.

* * * * *